US008666015B2

(12) United States Patent
Gahl et al.

(10) Patent No.: US 8,666,015 B2
(45) Date of Patent: Mar. 4, 2014

(54) METHOD AND APPARATUS FOR GENERATING THERMAL NEUTRONS USING AN ELECTRON ACCELERATOR

(75) Inventors: John M. Gahl, Columbia, MO (US); Gregory E. Dale, Fulton, MO (US)

(73) Assignee: The Curators of the University of Missouri, Columbia, MO (US)

( * ) Notice: Subject to any disclaimer, the term of this patent is extended or adjusted under 35 U.S.C. 154(b) by 1550 days.

(21) Appl. No.: 10/141,471

(22) Filed: May 8, 2002

(65) Prior Publication Data

US 2014/0029709 A1 Jan. 30, 2014

Related U.S. Application Data

(60) Provisional application No. 60/289,356, filed on May 8, 2001.

(51) Int. Cl.
*G21G 1/00* (2006.01)

(52) U.S. Cl.
USPC ..... 376/159; 376/156; 376/157; 376/190; 376/202

(58) Field of Classification Search
USPC ..... 376/159, 156, 157, 190
See application file for complete search history.

(56) References Cited

U.S. PATENT DOCUMENTS

| | | | | | |
|---|---|---|---|---|---|
| 2,253,035 | A | * | 8/1941 | Kallmann et. al. | 376/110 |
| 3,050,454 | A | | 8/1962 | Barr et. al. | |
| 3,089,958 | A | * | 5/1963 | Janner | 376/254 |
| 3,205,016 | A | * | 9/1965 | Panning | 406/105 |
| 3,417,245 | A | * | 12/1968 | Schmidt | 376/109 |
| 3,573,165 | A | * | 3/1971 | Pinajian | 376/189 |
| 3,676,675 | A | * | 7/1972 | Ransohoff et al. | 378/69 |
| 3,778,627 | A | * | 12/1973 | Carpenter | 376/192 |
| 3,786,258 | A | * | 1/1974 | Schmidt | 376/115 |
| 3,799,883 | A | | 3/1974 | Hirofumi et. al. | |
| 3,914,373 | A | | 10/1975 | Jepson | |
| 3,950,017 | A | * | 4/1976 | Beurer | 285/124.3 |
| 3,963,936 | A | * | 6/1976 | Lowe | 250/517.1 |
| 4,158,700 | A | | 6/1979 | Karageozian | |
| 4,200,491 | A | * | 4/1980 | Ball | 376/254 |

(Continued)

FOREIGN PATENT DOCUMENTS

FR 2 263 511 A * 11/1975 ..... G01N 23/00

OTHER PUBLICATIONS

L.A. Artsimovich, "Controlled Thermonuclear Reactions", Fordon and Breach Publishers, New York, first English Edition, 1964, pp. 1-9, especially p. 6.*

(Continued)

*Primary Examiner* — Johannes P Mondt
(74) *Attorney, Agent, or Firm* — Greer, Burns & Crain Ltd.

(57) ABSTRACT

Apparatus for generating thermal neutrons includes an electron accelerator for generating an electron beam and a converter for converting the electron beam into photons. A receiving device is provided for receiving the photons and includes a material which provides a photoneutron target for the photons, for producing high energy neutrons in a photonuclear reaction between the photons and the photoneutron target, and for moderating the high energy neutrons to generate the thermal neutrons. The electron beam has an energy level high enough to produce photons of sufficient energy to exceed the photodissociation threshold of the selected target material, but that is sufficiently low as to enable the material to moderate the high energy neutrons resulting from the photonuclear reaction.

19 Claims, 2 Drawing Sheets

(56) References Cited

U.S. PATENT DOCUMENTS

| | | | | | |
|---|---|---|---|---|---|
| 4,251,726 | A | * | 2/1981 | Alvarez | 376/159 |
| 4,266,132 | A | * | 5/1981 | Marshall, III | 250/359.1 |
| 4,310,765 | A | | 1/1982 | Givens | |
| 4,311,912 | A | | 1/1982 | Givens | |
| 4,397,810 | A | | 8/1983 | Salisbury | |
| 4,666,651 | A | | 5/1987 | Barjon et al. | |
| 4,713,581 | A | | 12/1987 | Haimson | |
| 4,727,791 | A | * | 3/1988 | Satoh | 91/47 |
| 5,095,486 | A | * | 3/1992 | Etievant | 372/2 |
| 5,280,505 | A | | 1/1994 | Hughey et al. | |
| RE34,575 | E | | 4/1994 | Klinkowstein et al. | |
| 5,392,319 | A | | 2/1995 | Eggers | |
| 5,468,355 | A | | 11/1995 | Shefer et al. | |
| 5,596,611 | A | | 1/1997 | Ball | |
| 5,661,377 | A | * | 8/1997 | Mishin et al. | 315/505 |
| 5,703,918 | A | * | 12/1997 | Hiismaki et al. | 376/458 |
| 5,870,447 | A | * | 2/1999 | Powell et al. | 376/194 |
| 5,903,622 | A | | 5/1999 | Yoon et al. | |
| 5,910,971 | A | | 6/1999 | Ponomarev-Stepnoy et al. | |
| 5,920,601 | A | | 7/1999 | Nigg et al. | |
| 5,949,836 | A | | 9/1999 | Lidsky et al. | |
| 5,976,066 | A | | 11/1999 | Yanch et al. | |
| 6,127,687 | A | * | 10/2000 | Williams et al. | 250/492.3 |
| 6,208,704 | B1 | | 3/2001 | Lidsky et al. | |

OTHER PUBLICATIONS

Archbutt et al, "Density of the Metallic Elements", in "International Critical Tables of Numercial Data, Physics, Chemistry & Technology" (National Research Council), Knovel 2003 (first electronic edition), p. 456.*

Front page of item V above.*

Abstract from INSPEC database to Doucas et al, "Conversion of the Oxford Van de Graaf into an electron accelerator", Nuclear Instruments & Methods Section A, Apr. 15, 1993, vol. A328, No. 1-2, p. 41-46 (ISSN: 0168-9002); The Netherlands.*

Periodic Table of the Elements, Los Alamos National laboratory, last updated Dec. 2003.*

Ongaro et al, "Monte Carlo Simulation and Experimental Evaluation of Photoneutron Spectra produced in medical linear accelerators", Proc. 1999 Particle Accelerator Conference, New York 1999.*

Utsunomiya et al, "Photoneutron Cross Section Measurements of 9Be using Laser-Induced Compton-Backscattered Photons", Nuclear Physics at Storage Rings, CP 512 (2000).*

Jackson, H.E., "Threshold Photoneutron Spectra", Int. Symp. Neutron Capture Gamma Ray Spectrascopy, Petten, Holland (i.e., The Netherlands), Sep. 2-6, 1974.*

EXFOR graphical plot of photoneutron cross section of 9Be(gamma,n)8Be based on R.D.Edge, Nuclear Physics 2, 485 (1957).*

Abstract, from INSPEC database, to Doucas et al., "Conversion of the Oxford Van de Graaff into an electron accelerator", Nuclear Instruments & Methods Section A, Apr. 15, 1993, vol. A238, No. 1-2, pp. 41-46 (ISSN: 0168-9002), The Netherlands (previously listed on PTO-892 mailed with Office action on Oct. 23, 2009 (item U).*

Bowman, C.D., "Efficient Neutron Production Using Low-Energy Electron Beams", Nuclear Science and Engineering: 75, pp. 12-15 (1980).

Brovtsyn et al., "Experimental investigation of a microtron as a neutron source for activation analysis", translated from Atomnaya Energiya, vol. 32, No. 5, pp. 383-388 (1972).

Chakhlov et al., "Photoneutron source on a compact 10 MeV betatron", Nuclear Instruments and Methods in Physics Research A, vol. 422, pp. 5-9 (1999).

Duckworth et al., "High-energy electron accelerators as pulsed neutron sources", Nature, No. 4153, p. 869 (1949).

Feld, B.T., "The linear electron accelerator as a pulsed neutron source", Nucleonics, vol. 9, No. 4, pp. 51-57 (1951).

Golovkov et al., "Measurement of the photoneutron flux density distribution from cylindrical targets", Translated from Soviet Physics Journal, vol. 32, No. 9, pp. 667-668 (1989).

Harker et al., "INEL and ISU BNCT research using a 2 MeV RFQ-based neutron source", Nuclear Instruments and Methods in Physics Research B., vol. 99, pp. 843-846 (1995).

Hunt, C.A., "Neutron radiography with a 5.5 MeV linear accelerator-beryllium source", British Journal of Non Destructive Testing, pp. 78-85, (1969).

Jallu et al., "Photoneutron production in tungsten, praseodymium, copper and beryllium by using high energy electron linear accelerator", Nuclear Instruments and Methods in Physics Research B., vol. 155, pp. 373-381 (1999).

Kase et al., "An assessment of the Continuous Neutron Source Using a Low-Energy Electron Accelerator", Nuclear Science and Engineering, vol. 126, pp. 59-70 (1997).

Kneeland, D.R., "Current Accelerators for Research and Industry", IEEE Transactions on Nuclear Science, vol. NS-28, No. 2, pp. 1452-1460 (1981).

Kovalev et al., "Isotropic neutron source using the LUE-25 linear electron accelerator", Translated from Atomnaya Energiya, vol. 32, No. 2, pp. 173-175 (1972).

Miley et al., "The IEC-A Plasma-target-Based Neutron Source", Applied Radiation and Isotopes, vol. 48, No. 10-12, pp. 1557-1561 (1997).

Moses et al., "Electron accelerator used for producing neutrons", Nucleonics, vol. 14, No. 9, pp. 118-119 (1956).

Ratcliffe, B.J., "Development of non-reactor neutron radiographic assembly using a 12 MeV linear electron accelerator", British Journal of Non Destructive Testing, pp. 94-98 (1988).

Swenson, D.A., "Compact, inexpensive, epithermal neutron source for BNCT", Applications of Accelerators in Research and Industry, CP475, pp. 1037-1040 (1999).

Vasina et al., "Photoneutron Yields from Targets of $^{2}H_{2}O$, Be, and $^{238}U$ Irradiation with Bremsstrahlung from 4-to 8-MeV Electrons", Translated from Atomnaya Energiya, vol. 66 No. 1, pp. 56-57 (1989).

Wang et al., "A neutronic study of an accelerator-based neutron irradiation facility for boron neutron capture therapy", Nuclear Technology, vol. 84, pp. 93-107 (1989).

Yanch et al., "Design of low-energy beams for boron neutron capture synovectomy", SPIE vol. 2867, pp. 31-40 (1997).

Yanch et al., "Research in boron neutron capture therapy at MIT LABA", Applications of Accelerators in Research and Industry, pp. 1281-1284 (1997).

* cited by examiner

METHOD AND APPARATUS FOR GENERATING THERMAL NEUTRONS USING AN ELECTRON ACCELERATOR

This application claims the benefit of U.S. Provisional Application No. 60/289,356, filed May 8, 2001.

FIELD OF INVENTION

The present invention generally relates to neutron generators, and more particularly to a neutron generator employing an electron accelerator for producing thermal neutrons.

BACKGROUND

There are many industrial and clinical applications requiring a high flux of thermal neutrons. A neutron is considered to be thermal when it is in thermal equilibrium with the surrounding materials. Thermal neutrons have a Maxwellian distribution of energies and can be generally considered to have a kinetic energy less than 1 eV (electron-volt). Examples of industrial applications include neutron radiography and Prompt Gamma Neutron Activation Analysis (PGNAA). Some examples of clinical applications include production of radioactive stents used in the prevention of restenosis following arterial intervention, such as balloon angioplasty, and production of short lived radioisotopes used in radiation synovectomy or brachytherapy.

Hampering the continued development of these applications is often the lack of a suitable neutron source. The highest thermal neutron fluxes are produced in nuclear research reactors. These facilities, however, are few in number and often lack the clinical environment necessary for medical research. Other types of neutron sources include radioisotope sources, fusion sources, cyclotrons, and ion accelerators. Much work has gone into the development of these neutron sources with many variations in each category. However, a neutron source that has a high thermal flux suitable for installation in industrial or clinical environments is not generally available. Furthermore, the cost of many of these systems is beyond the reach of many institutions that could make use of the technology.

Another known method of producing neutrons is with an electron accelerator fitted with an x-ray converter and a photoneutron target. In one system, a high power (1 MW) continuous current electron accelerator is used to generate a 30 MeV electron beam, which is incident on a Tungsten target of the x-ray converter. The resulting bremsstrahlung photons are then directed to a tank of heavy water, thereby producing high energy neutrons (up to 14 MeV). While this system may maximize the photoneutron yield, the energy of these neutrons is too high to be thermalized effectively. Such high energy photons and neutrons also requires a massive thickness of biological shielding. Moreover, the high power electron accelerator would make the system relatively large, extremely expensive to build and to operate, and would stretch the technical expertise of a typical radiology department. These types of electron accelerators are primarily used for research and do not have the reliability required for use in a clinical setting.

SUMMARY OF THE INVENTION

The present invention is directed to an apparatus for generating thermal neutrons and includes an electron accelerator for generating an electron beam and a converter for converting the electron beam into photons. A receiving device is provided for receiving the photons and includes a material which provides a photoneutron target for the photons, for producing high energy neutrons in a photonuclear reaction between the photons and the photoneutron target, and for moderating the high energy neutrons to generate the thermal neutrons. The electron beam has an energy level that is sufficiently low as to enable the material to moderate the high energy neutrons resulting from the photonuclear reaction.

DETAILED DESCRIPTION OF THE INVENTION

Figure 1:
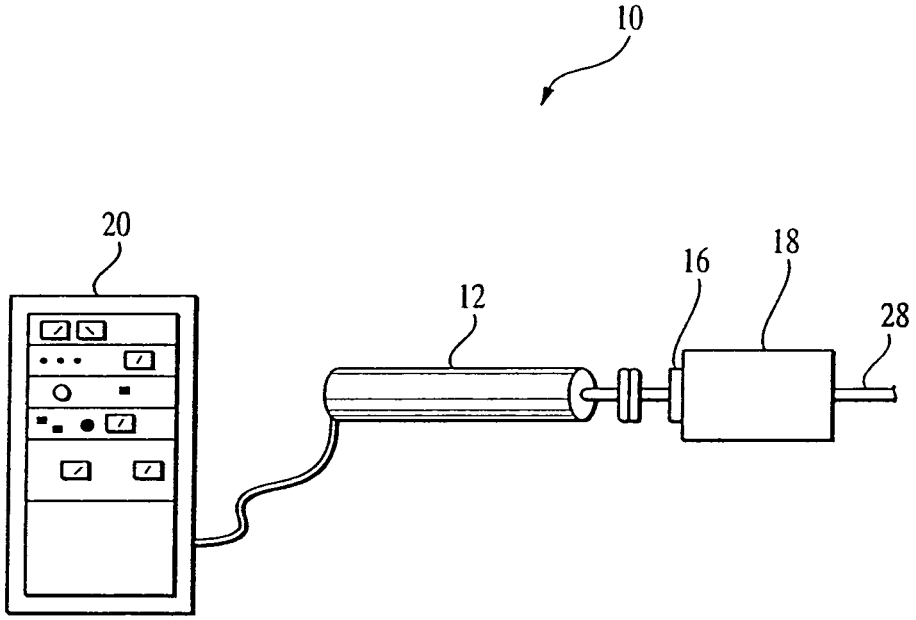
FIG. 1 is a block diagram of an apparatus for generating thermal neutrons in accordance with an embodiment of the present invention.

Turning now to FIG. 1, a neutron generating device in accordance with an embodiment of the present invention is indicated generally at 10, and includes an electron linear accelerator (LINAC) 12 for producing a beam of electrons which is incident 14 incident on an x-ray converter 16. The x-ray converter 16 is attached to a neutron irradiator 18, and produces photons that are directed into the neutron irradiator, where thermal neutrons are generated. The LINAC 12 is connected to a control device 20 a for controlling electron beam 14 output (shown in FIGS. 2 and 3).

The LINAC 12 of the invention is preferably a commercially available, repetitively pulsed type used, for example, in hospitals for photon radiotherapy. The LINAC 12 has an electron beam energy from approximately 5 to approximately 30 MeV, but preferably in the range of approximately 5-15 MeV, and an electron beam current of approximately 0.1 to 1 mA or 1 to 10 kW for a 10 MeV electron beam.

Figure 2:
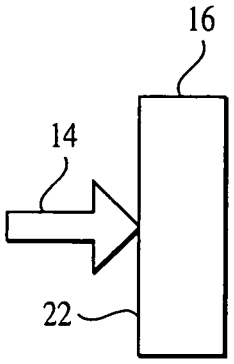
FIG. 2 is a side view of an x-ray converter shown in FIG. 1.

Turning to FIG. 2, the x-ray converter 16 is made of a material having an atomic number or Z of at least 26, but preferably higher than 70, for example, tantalum (Ta, Z=73) or tungsten (W, Z=74). The thickness of the converter 16 is approximately 30% to 50% of the incident electron range evaluated in the Continuous Slowing Down Approximation (CSDA). As an electron, or other charged particle, traverses a medium it loses energy to the medium through discrete collisions. On average, however, these discrete interactions can be approximated as a continuous energy loss over a differential path length. This energy loss per differential path length is known as the stopping power. This approximation is known as the Continuous Slowing Down Approximation (CSDA). The total path length necessary to reduce the charged particle to zero energy is known as the particles (electron) range. The x-ray converter 16 is generally cylindrical and has a diameter of approximately 2 inches. It should be understood, however, that other shapes and diameters of the converter assembly 16 may be used without significant impact on the performance of the converter assembly 16.

When the electron beam 14 is incident on the front surface 22 of the converter 16, bremsstrahlung photons are produced as the electrons slow down in the converter. This process is most efficient in producing photons when the electrons are stopped in a material of high atomic number, such as Ta or W, for example, used in the preferred embodiment. Experiments have shown that the x-ray converter 16 fitted to a 10 MeV LINAC 12 converts approximately 17% of the electron beam 14 power into photons. This figure rapidly increases with electron energy. The maximum photon production occurs when the converter 16 thickness is approximately 30% to 50% of the incident electron range evaluated using the CSDA method. Electrons that have penetrated further than 50% of the CSDA range typically have too little energy to create bremsstrahlung photons.

Figure 3:
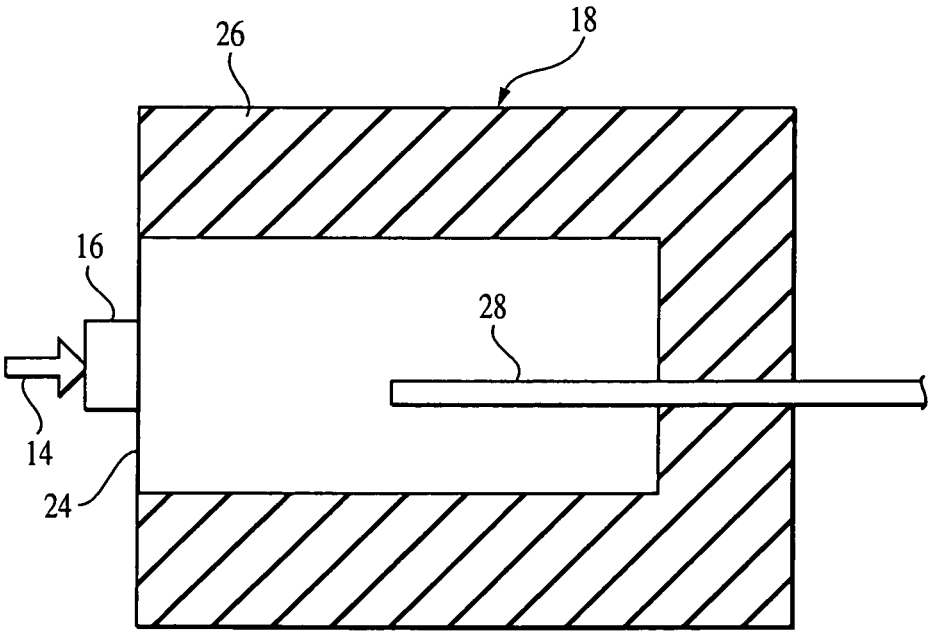
FIG. 3 is a sectional view of a neutron irradiator shown in FIG. 1.

Turning now to FIG. 3, the neutron irradiator 18 includes a tank 24 for holding heavy water, $^2H_2O$. The tank 24 is provided inside a neutron reflector 26 for reflecting escaping neutrons back into the tank 24. The tank 24 may be made of any material that holds water and generally resistant to absorption of neutrons. Polyethelene is an example. The neutron irradiator 18 also includes a sample delivery tube 28 which extends through the reflector 26 and into the tank 24. The tank 24 may be any size and should be sufficiently large enough for a desired thermal neutron yield. For example, in excess of $3\times10^{12}$ n/sec (neutrons/second) is produced in a 10 L tank with a 10 kW electron beam. Higher neutron yield may be obtained in a larger tank 24 of heavy water.

In the preferred embodiment, the reflector 26 has a thickness of approximately 30 cm to 60 cm, and can be any neutron reflecting material such as, for example, graphite, light water, heavy water, polyethelene or other polymer, or lead. The thickness of the reflector may vary depending on the size of the photoneutron target (tank) 24 and the reflector 26 material. A different reflector 26 material may be used on the top or bottom of the tank 24 than on the radial side of the tank. The sample delivery tube 28 is a pneumatic type tube which carries a sample (not shown) to be irradiated with thermal neutrons into and out of the neutron generating tank 24. The sample delivery tube 28 should be large enough to carry the item to be irradiated. This will vary depending on the application. The sample delivery tube 28 should also be waterproof and generally resistant to absorption of neutrons. Polyethylene or crystal polystyrene are examples.

In operation, a sample (not shown) to be irradiated with thermal neutrons is injected into the neutron generating tank 24 using the sample delivery tube 28. The LINAC 12 is set by the control device 20 to generate an electron beam having the desired energy level, which is converted into photons by the x-ray converter 16. The photons are injected into the tank 24, where neutrons are produced through a photonuclear reaction with heavy water. A photonuclear reaction occurs when a photon has sufficient energy to overcome the binding energy of the neutron in the nucleus of an atom. In the reaction the photon is absorbed by the nucleus and a neutron is emitted with relatively high energy. In the present invention, neutrons are produced in a photonuclear reaction in deuterium, $^2H$ (which is an isotope of hydrogen having a mass number of 2) found in heavy water, $^2H_2O$. Deuterium has a low photonuclear threshold energy of 2.23 MeV. Thus, photons created from the LINAC 12 having electron energies preferably in the range of approximately 5-15 MeV are sufficient to cause a photonuclear reaction in heavy water and generate high energy neutrons. The high energy neutrons are then slowed down, or moderated, to thermal energies by heavy water. Because of its small neutron absorption cross section and low effective atomic mass, heavy water functions also as a moderator. The thermal neutrons are then captured by the sample, and the radioactive sample is then removed from the tank 24 through the delivery tube 28, and used in various therapies.

From the foregoing description, it should be understood that a thermal neutron generator has been shown and described which has many desirable attributes and advantages. The neutron generator includes a readily available low energy electron generator, which makes the present invention suitable for installation in industrial or clinical environments.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. Apparatus for irradiating a sample with thermal neutrons, comprising:

a pulsed electron accelerator for generating an electron beam having a beam power substantially less than 1 MW;

an x-ray converter for converting said electron beam into photons;

irradiating means for receiving said photons and including a material for providing a photoneutron target for said photons, for producing high energy neutrons in a photonuclear reaction between said photons and said photoneutron target, and for moderating said high energy neutrons to generate said thermal neutrons; and, means for removably introducing the sample in said irradiating means, so that the sample is irradiated with the thermal neutrons generated in said irradiating means.

2. The apparatus as defined in claim 1 wherein said electron beam has an energy level from approximately 5 MeV to approximately 30 MeV, and an electron beam current of less than approximately 1 mA.

3. The apparatus as defined in claim 2 wherein said electron beam has an energy level from approximately 5 MeV to approximately 15 MeV, and an electron beam current of approximately 0.1 to 1 mA.

4. The apparatus as defined in claim 2 further including a control device operatively connected to said electron accelerator for controlling at least said energy level of said electron beam.

5. The apparatus as defined in claim 1 wherein said irradiating means includes a container for holding said material and a reflector surrounding said container for reflecting said high energy neutrons back into said container to further moderate said high energy neutrons.

6. The apparatus as defined in claim 5 wherein said container holds at least heavy water.

7. The apparatus as defined in claim 5 wherein said reflector includes one of graphite, light water, polyethylene or other polymer and lead.

8. The apparatus as defined in claim 5 wherein said sample introducing means is a tube that extends through said reflector and into said container, and pneumatically delivers the sample into and out of said container.

9. The apparatus as defined in claim 8 wherein said tube is substantially waterproof and resistant to neutron absorption.

10. A method of irradiating a sample with thermal neutrons, comprising the steps of:

introducing the sample in a container that holds heavy water that provides a photoneutron target for photons, for producing high energy neutrons in a photonuclear reaction between said photons and said photoneutron target, and that moderates said high energy neutrons for generating the thermal neutrons;

generating an electron beam having a beam power which is substantially less than 1 MW, using a low energy pulsed electron accelerator;

directing said electron beam to be incident on an x-ray converter to generate said photons for said photonuclear reaction; and, injecting said photons into said container to create said photonuclear reaction, so that the sample is irradiated with the thermal neutrons generated in said container.

11. The method as defined in claim 10 further including the step of surrounding said container with a reflector to reflect said high energy neutrons back into said container to further moderate said high energy neutrons.

12. The apparatus as defined in claim 5 wherein said reflecting means includes any one of light water, polyethylene or other polymer and lead.

13. The apparatus as defined in claim 1 wherein said x-ray converter has a thickness of approximately 30% to 50% of the incident electron range of the electron beam as determined by the continuous slowing down approximation.

14. The apparatus as defined in claim 13 wherein said x-ray converter is formed from tungsten.

15. The apparatus as defined in claim 13 wherein said x-ray converter is formed from tantalum.

16. The apparatus as defined in claim 1 wherein said electron beam has an energy level from approximately 5 MeV to approximately 15 MeV.

17. The apparatus as defined in claim 1 wherein said sample introducing means comprises a supply tube that extends from outside of said irradiating means into inside of said irradiating means.

18. The method as defined in claim 10, wherein the sample is introduced into the container through a delivery device which extends into the container from the outside of the container.

19. The method as defined in claim 18 wherein the sample is carried through the sample delivery device pneumatically.

* * * * *

UNITED STATES PATENT AND TRADEMARK OFFICE

CERTIFICATE OF CORRECTION

PATENT NO. : 8,666,015 B2
APPLICATION NO. : 10/141471
DATED : March 4, 2014
INVENTOR(S) : Gahl et al.

It is certified that error appears in the above-identified patent and that said Letters Patent is hereby corrected as shown below:

On the Title Page:

(56) References Cited

Page 1, Right Column, line 16,
"Other Publications" Please delete "Fordon" and insert --Gordon-- in its place.

In the Specification:

Col. 2, line 26 After "is incident", please delete "14 incident".

Col. 2, line 30 Before "for controlling", please delete "a".

Signed and Sealed this
Thirtieth Day of September, 2014

Michelle K. Lee

Michelle K. Lee
*Deputy Director of the United States Patent and Trademark Office*